US006035797A

United States Patent [19]

Robinson

[11] Patent Number: 6,035,797

[45] Date of Patent: Mar. 14, 2000

[54] FLOAT DRUM

[75] Inventor: Mark D. Robinson, Wheeling, W. Va.

[73] Assignee: The Louis Berkman Company, Cleveland, Ohio

[21] Appl. No.: 09/092,882

[22] Filed: Jun. 8, 1998

[51] Int. Cl.[7] ..... B63B 38/00

[52] U.S. Cl. ..... 114/267; 114/263

[58] Field of Search ..... 114/263, 266, 114/267; 405/219

[56] References Cited

U.S. PATENT DOCUMENTS

| | | | |
|---|---|---|---|
| 2,866,985 | 1/1959 | Blackmore . | |
| 3,242,245 | 3/1966 | Greig et al. . | |
| 3,250,660 | 5/1966 | Greig et al. . | |
| 3,412,183 | 11/1968 | Anderson et al. . | |
| 3,446,172 | 5/1969 | Morton et al. . | |
| 3,599,257 | 8/1971 | Erickson . | |
| 3,752,102 | 8/1973 | Shuman . | |
| 3,921,238 | 11/1975 | Johnson | 114/267 |
| 4,161,796 | 7/1979 | Kostanecki . | |
| 4,365,577 | 12/1982 | Heinrich . | |
| 4,799,445 | 1/1989 | Meriwether . | |
| 4,940,021 | 7/1990 | Rytand | 114/267 |
| 4,974,538 | 12/1990 | Meriwether . | |

FOREIGN PATENT DOCUMENTS

| | | |
|---|---|---|
| 5-228944 | 9/1993 | Japan . |

*Primary Examiner*—Sherman Basinger
*Attorney, Agent, or Firm*—Vickers, Daniels & Young

[57] ABSTRACT

An improved float drum for marine structures which includes a floatation material in the interior of the float drum which conforms to the interior surfaces of the walls of the float drum. The float drum also includes a fluid regulator to prevent a build-up of gasses in the interior of the float drum from deforming or damaging the float drum. The float drum also designed conveniently accommodate dock utility systems.

66 Claims, 3 Drawing Sheets

FLOAT DRUM

This invention relates generally to float drums and more particularly to plastic float drums which are filled with a flotation material. The invention is particularly applicable to float drums for use with floating docks, floating pipe lines, swim floats and the like and will be described with particular reference thereto. However, it will be appreciated that the invention may have broader application and may be used to provide buoyancy to any structure desired to be floated in a liquid medium.

INCORPORATION BY REFERENCE

The following documents are incorporated herein by reference: Meriwether U.S. Pat. No. 4,974,538; Meriwether U.S. Pat. No. 4,799,445; Heinrich U.S. Pat. No. 4,365,577; Shuman U.S. Pat. No. 3,752,102; Anderson U.S. Pat. No. 3,412,183; Greig U.S. Pat. No. 3,250,660; and Greig U.S. Pat. No. 3,242,245.

BACKGROUND OF THE INVENTION

Float drums have evolved from crude sealed metal drum and blocks of Styrofoam into hollow polyethylene shells which are precisely configured and designed to fit especially within intricate dock structures typically sold in kit form. An example of an early design of a hollow polyethylene float is disclosed in the Shuman U.S. Pat. No. 3,752,102 and marketed under the "Dayton" brand name. Meriwether U.S. Pat. No. 4,974,538 and Meriwether U.S. Pat. No. 4,799,445 describe the current, state of the art polyethylene float and the integration of the float within sophisticated floating marine structures. Specifically, today's floats are constructed with rigidized circumscribing flanges for secure mounting to the dock structure; ribs secured to the underside of the flange for strengthening the side walls and the flange and spaced indentations horizontally positioned on the float which also strengthen the float walls while providing indentations for receiving dock structure members or, alternatively, for interlocking the float drums one on top of the other or side-by-side.

Polyethylene float drums are typically formed as hollow shells in a process generally described in the trade as "twin sheet forming." The process is generally described in the process patents incorporated by reference herein. The floats are then marketed either as hollow, air filled floats or the floats are filled with a flotation material. In the latter instance, a hole is provided in the drum and a urethane foam is injected into the float, expanded and cured. As noted in Heinrich U.S. Pat. No. 4,365,577, the urethane is usually introduced into the float while the float is still confined to prevent bulging. When the urethane is cured, the filled float provides a somewhat rigid foam reinforcement for polyethylene walls thus adding strength to the float while also preventing leakage of water into the float if the polyethylene walls are accidentally or maliciously punctured.

While the foam filled polyethylene floats have inherent advantages over hollow or air filled floats, in practice problems have been encountered. First, the urethane foam which is injected into the float does not expand against all the walls of the float during the curing process. Spaces between the foam and the polyethylene walls inevitably occur with the result that the wall can flex until encountering the cured foam. While the float would not sink even if the walls could flex to the point of rupture, the strength or rigidity of the float is obviously less than what is otherwise possible. Another problem which has been encountered is that, inherent in the twin sheet forming process, shrinkage does occur when the polyester dries. Because of the especially configured shape of the drum which prevents the form from uniformly contorting the entire wall surface, the walls can become bowed. The bowed or distorted walls which are not corrected by the foam fill make the float aesthetically unattractive and can interfere with the usefulness of the indentation features, etc.

This problem was addressed in Meriwether U.S. Pat. No. 4,974,538 which provided a polyethylene float drum for supporting marine structures which included top and bottom flanges that are integrally sealed together and a solid, core of preformed flotation material which substantially fills the entire volume of the configured enclosure so that the polyethylene float is positively assured of having rigidized wall surfaces. The preformed material used is preferably polystyrene.

Although the problems associated with spaces between the foam and walls of the float drum are addressed in Meriwether U.S. Pat. No. 4,974,538, problems still exist with deformation of the float drum due to the expansion of gases in the sealed float drum. It has been found that the foam in the float drum may undergo additional curing when the float drum is exposed to heated environments. The curing of the foam results in the formation of gases which cause an increase in pressure within the sealed float drum. Over time, the pressure increase causes the sides of the float drum to deform and ultimately cause the float drum to rupture. One solution to this problem has been to insert a small opening in the float drum to allow the gases to escape. However, the opening allows water to enter the float which compromises the buoyancy of the float drum and can damage the foam in the float drum.

Another problem with existing float drums is that it is difficult to install utility wires, plumbing, etc. on the float drums. Typically, the utility systems are attached to the surface on the dock. This placement of such utility systems are not aesthetically pleasing and are unwanted obstacles on the surface of the deck.

In view of the state of the art of float drums, there is a need for a float drum which resists deformation after the foam in the float drum is initially cured and a float drum which is adapted to be conveniently used with dock utility systems.

SUMMARY OF THE INVENTION

The invention pertains to an improved float drum that resists deformation during use and can be used in a variety of dock system arrangements.

Accordingly, the invention pertains to a plastic float drum which is substantially completely filled with a flotation material and includes a vent opening adapted to release pressure in the interior of the float drum and to prevent water from entering the float drum when the float drum is placed in the water. Preferably, the float drum is made of a plastic material, such as polyethylene. The float drum is designed to support marine structures, such as dock decks. In one particular arrangement, the float drum includes a configures hollow top wall portion terminating in a circumscribing top flange and a configured hollow bottom wall portion terminating in a circumscribing bottom flange. The top and bottom flanges are integrally sealed together so that the top and bottom portions define an enclosure having a predetermined configuration. Alternatively, the float drum can be blow molten to form a single piece unit. The interior of the float drum is hollow and is defined by the interior surfaces of the top and bottom float portions. The interior of the drum is filled with a material that forms a substantially solid core of flotation material. The flotation material substantially fills the entire volume of the interior of the float drum so that this float drum has rigidized wall surfaces and ensures that the float drum will remain positively buoyant if a rupture occurred in the float drum. The core material is preferably polystyrene; however, other buoyant core materials can be used. Preferably, the external portions of the core conform at least nearly exactly to the internal dimensions of the top and bottom portions of the float drum so that the float drum has closely controlled dimensional tolerances without the pressure of buckled or wavy walls and the like.

In accordance with another feature of the invention, the bottom wall portion of the float has a bottom wall, a pair of contiguous side walls extending from the sides of the bottom wall and a pair of contiguous end walls extending from the ends of the bottom wall. Each end wall is contiguous with a side wall and each side and end wall terminates in the load bearing bottom side flange which circumscribes the bottom wall portion and extends away from the side and end walls. At least one of the side walls is relatively flat and preferably has at least one flange supporting rib integrally formed therein and interrupting the flatness of the side wall. At least one end wall also preferably includes a flange supporting rib integrally formed therein. The rib preferably has the shape of a semi-circular truncated cone with the larger diameter portion integral with the bottom side flange and its smaller diameter portion somewhat adjacent the bottom wall. However, the rib may have other shapes. The side walls and bottom wall preferably includes at least one indention. Preferably the indentions are aligned to form a continuous indention from the side wall, to the bottom wall and ending on the other side wall. The core has a bottom wall, a pair of contiguous end walls extending from the ends of the bottom wall and a pair of side walls extending from the sides of the bottom wall with the side walls and the end walls terminating in a top wall. The core side and end walls conform with the shape of the flange and/or indentions in the side, end and bottom walls. Importantly, the core is at least substantially in full contact with the interior surface of the interior bottom portion of the float drum to insure the rigidity strength of the side walls end, and bottom walls of the float drum. The top wall portion of the float drum has a top wall, a pair of contiguous end walls extending from the ends of the top wall and a pair of contiguous side walls extending from the sides of the top wall with the end and side walls terminating in the load bearing rigidizing top side flange. The top wall of the top portion of the polyethylene float is generally flat and partially rectangular in cross-sectional configuration.

In accordance with still another feature of the present invention, the float drum includes at least one vent opening designed to release gas pressure which builds up in the interior of the float drum. Flotation core material, such as polysyrens, are heated to cure the core material. Typically, the core material is blown or poured into the interior of the float drum and then heated to cure the flotation material. Thereafter, the float drum openings are sealed. Typically, only a majority of flotation material is completely cured during the curing process. Thus, the curing process may still continue or later be activated again. The curing process can be reactivated when the float drum is exposed to a heated environment, such as being exposed to the sun, the interior of the float drum can increase in temperature and begin the curing process of the uncured flotation material. Gases are released from the curing process. The vent opening is designed to allow these formed gases to escape from the interior of the float drum. In one embodiment, the vent opening is positioned on the top portion of the float drum to allow easy access to the vent opening. Preferably, the vent opening is a small opening, i.e. less than a two inch diameter hole. Preferably, the vent opening is designed to accommodate a plug. The plug is designed to seal the vent opening and prevent water from entering the interior of the float drum when the float drum is placed in the water. In one embodiment, the plug is threaded and adapted to be screwed into the vent opening to seal the vent opening. In another embodiment, the plug includes a valve which can be opening and closed, i.e., a pop-up valve, a switch valve, or the like. In still another embodiment, the plug includes a one way valve which only allows fluids to exit the interior of the float drum and prevents fluids to enter the interior of the float drum. In such an arrangement, the one way valve opens after a threshold pressure between the interior of the float drum and exterior of float drum is reached. The valve allows the pressure in the interior of the float drum to reduce until the differences in pressure falls below the threshold pressure. Once the pressure in the interior of the float drum sufficiently is reduced, the valve closes.

In accordance with still yet another aspect of the present invention, the top portion of the float drum includes a utility groove to accommodate utility pipes, wires, etc. The utility groove is depressed from the generally flat surface of the top portion of the float drum so that the utility components can be placed within the groove and secured in the groove when the deck boards are placed on the top portion of the float drum. The utility grooves also help to rigify/strengthen the top portion of the float drum. The utility grooves are also designed to assist in positioning the float drums in a particular arrangement and can be used to maintain the position of the float drum in relation to one another. Preferably the top portion includes two utility grooves, one groove extending the complete length of the top portion and one groove spanning the complete width of the top portion. In one preferred embodiment, one utility groove extends down the middle of the top portion and the complete length of the top portion. In another embodiment, the utility groove is semi circular in shape to accommodate and to cradle a utility pipe.

In accordance with another aspect of the present invention the top side flange includes markers to indicate reference points for inserting holes into the flange to attach decking or the like to the float drum. In one embodiment, the top side flange does not include holes for attachment of decking thereby requiring holes to be inserted into the top portion flange prior to attaching decking or the like to the float drum. The reference markers provide a visual marker on the top flange portion to allow the installer to easily install the float drums and dock structure.

In accordance with yet another feature of the invention, the thickness of the walls of the lower portion of the float drum may be reduced from that conventionally used to effect a raw material savings and a lower cost float drum. In connection with this feature, it is contemplated that while any number of lightweight, buoyant compositions which are capable of being molded into a preformed shape can be used. The flotation material, such as a polystyrene core, preferably has a composition which produces a compressive strength at least equal to and preferably higher than that of the foam filled plastics now used in the floats. In accordance with a more specific aspect of the invention, the thickness of the load bearing flanges on the float may be kept at present day standards while the thickness in the wall sections could be reduced.

It is the principal object of the present invention to provide a float drum which resists deformation.

It is another object of the present invention to provide a float drum which includes a pressure release device to reduce the pressure in the interim of the float drum.

It is yet another object of the present invention to provide a float drum which can easily accommodate a utility system.

It is still yet another object of the present invention to provide a float drum which includes visual indications for drilling holes to attach a structure to the float drum.

It is another object of the present invention to provide a filled float for marine application which is rigidized and/or strengthened when compared to conventional foam filled float drums.

It is yet another object of the present invention to provide a filled float drum which does not have buckled or bowed walls and/or is produced within consistent closely controlled dimensional tolerances.

It is still yet another object of the invention to provide a filled, plastic float drum which uses a lesser amount of plastic than conventional polyethylene float drums.

Still yet another object of the invention is to provide a filled float drum which is more economical than conventional float drums.

These object and other features of the present invention will become apparent to those skilled in the art from a reading and understanding of the following detailed description of the specification taken together with the accompanying drawings.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE PREFERRED EMBODIMENT

Figure 1:
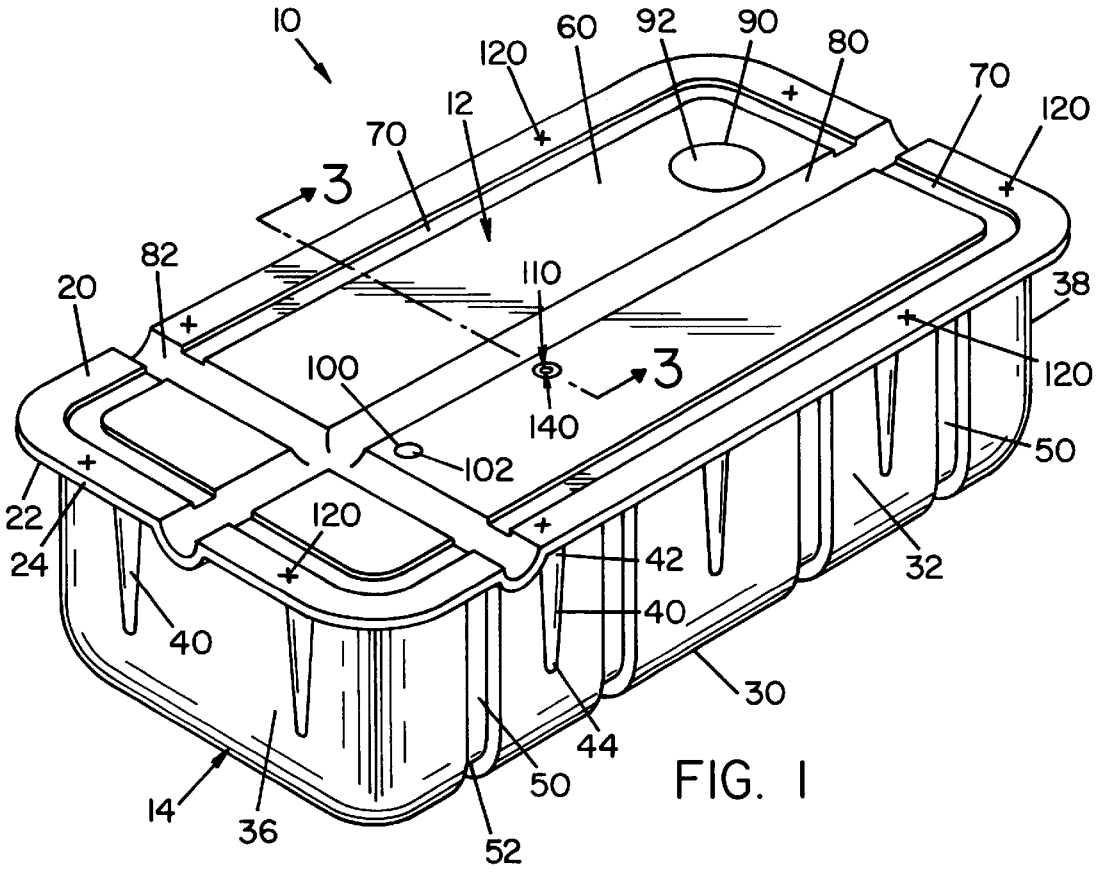
FIG. 1 is a perspective view of the float drum embodying the present invention.

Referring now to the drawings wherein the showings are for the purpose of illustrating the preferred embodiment of the invention only and not for the purpose of limiting the same, FIG. 1 shows a float drum 10 for supporting marine structures and the like. Float drum 10 has a top portion 12 which includes a circumscribing top flange 20. Float drum 10 has a configured bottom hollowed portion 14 which includes a circumscribing bottom flange 22. In one embodiment, top flange 20 is heat fused to bottom flange 22 to produce an integral load bearing flange 24 circumscribing float drum 10. In another embodiment, float drum 10 is blow molded thus top flange 20 and bottom flange 22 are formed as an integral load bearing flange 24. Top and bottom hollowed portions 12, 14 define a space or an enclosure which has a predetermined configuration defined by the interior surfaces of top and bottom portions 12, 14.

As described in greater detail in U.S. Pat. Nos. 4,974,538 and 4,799,445, circumscribing flange 24 is a load bearing rigidizing support flange and can take the shape of a spaced-a-part configuration or the flanges can simply abut one another. For the drum illustrated in FIG. 1, the flange arrangement shown simply abut one another.

Float drum 10 is configured in a shape which rigidizes the float walls while also providing a configuration which can receive or nest various standard risers of structural lumber (principally 2×4's and 2×6's) or metal shapes to permit the float to be mounted in a variety of positions to the marine structure or alternatively to be cross braced with appropriate stringers and the like. The term "marine structure" as used herein and in the claims, broadly means any structure which is to be placed in water for support purposes. Examples of marine structures are docks, swim rafts, pipe line support structures, etc.

Bottom portion 14 is defined by generally rectangular bottom wall 30. Extending upwardly from opposite sides of bottom wall 30 are side walls 32, 34 which terminate in bottom flange 22. Similarly, extending from the ends of bottom wall 30 are end walls 36, 38 which likewise extend upwardly and terminate at bottom flange 22. A plurality of flange supporting ribs 40 are molded into side walls 32, 34 and end walls 36, 38 to support load bearing flange 24 while rigidizing bottom portion 14. As best shown in FIG. 1, ribs 40 are essentially columnar supports which extend from the underside of bottom flange portion 22 to a position somewhat adjacent bottom wall 30 and for the float drum shown are generally in the shape of a semi-circular truncated cone having its larger diameter portion 42 adjacent and integral with bottom flange 22 and its minor diameter portion 44 adjacent bottom wall 30. As can be appreciated, the flange support ribs 40 may have other shapes.

Side walls 32, 34 and bottom wall 30 are generally flat and to increase their rigidity, side wall indentations 50 are provided in side walls 32, 34 and bottom wall indentations 52 are provided in bottom wall 30 with bottom wall indentations 52 lined with side wall indentations 50. The indentations 50, 52 can be viewed as rectangularly depressed slots which extend the entire length of side walls 32, 34 and bottom wall 30. Optionally, indentations could be provided in end walls 36, 38. As can be appreciated, the indentions can have other shapes.

Top portion 12 has a top wall 60. Top wall 60 is contiguous with and terminate at top flange 20 which, like bottom flange 22, extends outwardly away from top wall 60. As was done for bottom portion 14, top portion 12 is rigidized by a generally rectangular indentation 70 formed in the substantially flat top wall 60 and extend about the perimeter of top wall 60. As shown in FIG. 1, indentation 70 forms a shallow ridge about the perimeter of top wall 60 thereby rigifying top portion 12. Indentation 70 also acts as a channel to channel water off the top of top wall 60.

Top wall 60 also includes two structural ribs 80, 82. Structural rib 80 is designed to extend the complete longitudinal length of top portion 12. Structural rib 82 is designed to extend the complete lateral length of top portion 12. Structural ribs 80, 82 are dimensionally sized to permit pipes, cables, electrical wires and the like to be nested therein. The structural ribs are also designed to rigify top portion 12. As shown in FIG. 1, structural ribs 80,82 are semicircular in shape; however, other shapes can be used. The structural ribs are shown to be depressed further into top wall 60 than indentation 70. As can be appreciated, water which drains into indentation 70 is channeled to the structural ribs wherein the water is channeled off of the float drum. In the embodiment shown in FIG. 1, structural rib 80 is positioned substantially in this middle of top portion 12 and structural rib 82 is positioned nearer to one end of top portion 12 thereby forming a cross-like shape on top wall 60. Structural rib 80 is preferably placed in the middle of top portion 12 to evenly distribute the load along the longitudinal length of the float drum. The lateral length of top portion 12 is less than the longitudinal length, thus the positioning of structural rib 82 does not as greatly affect the load distribution on the float drum. Generally, the longitudinal length of the top portion is about 1.5–4 times the lateral length of the top portion. In one particular embodiment, the lateral length of the top portion is about two feet, the longitudinal length of the top portion is about four feet, structural rib 80 is spaced about 6–12 inches from the side of the top portion and structural rib 82 is spaced about 6–24 inches from the side of the top portion.

Referring again to FIG. 1, top wall 60 includes openings 90, 100, 110. These openings are used to place a floatation substance 130 such as urethane foam, polystyrene, etc. into the interior of the float drum. As can be appreciated one or more openings may be used; however, two to four openings have been found to be sufficient to fill the float drum with a flotation material.

Attachment indicators 120 are shown in FIG. 1 to be positioned on top flange 20. Indicators 120 mark a position wherein a dock structure can be attached to the float drum. Indication 120 are suggested points of attachment and can be used as reference points when connecting a plurality of float drums to a dock system. Indicators 120 are preferably a marking of some type that may include small depressions or small raised points in the top flange, painted or other colored markings, small holes, etc.

The method of forming top portion 12 and bottom portion 14 by blow molding or by a twin sheet process is known in the art and will not be described in detail. In a twin sheet process, top portion 12 is formed from a sheet of a fusible, thermal plastic material and bottom portion 14 is formed from another sheet of a fusible, thermal plastic material. Preferably, the sheets are polyethylene. However, reference should be had to the patents incorporated by reference herein which describe in greater detail the range of plastics from which float drum 10 can be manufactured by means of the twin sheet process. Basically, the polyethylene sheets are initially heated by means of heaters to a sag condition. One sheet is positioned over a generally fixed or immovable stationary die which is formed in the shape of bottom portion 14. A plurality of passages formed in the stationary die which communicate with the interior of the die to permit a vacuum to be drawn through the die so that sheet is pulled into the configuration of the die. Top portion 12 can be formed from a thinner sheet typically 0.090 inches when compared to bottom portion 14 which is preferably formed from a thicker sheet of plastic, i.e. 0.200 inches. However, the thickness of top portion 12 and bottom portion 14 may be substantially the same. Because bottom portion 14 is deeper than top portion 12 and because bottom portion 14 has an especially shaped configuration, a plug may be used when forming the bottom sheet into the configuration of bottom portion 14. The sheet for top portion 12 is drawn into its configuration by a movable die which has vacuum openings to draw the sheet into the desired configuration. Because of the relatively shallow dimension of top portion 12, a plug is not necessary to form top portion 12 in the movable die. Once top portion 12 and bottom portion 14 are formed, top flange portion 20 is fused with bottom flange portion 22 to produce an integral flange 24. The polyethylene is allowed to cool to its hardened state while the dies remain mated to one another. If float drum 10 is to be filled with a flotation substance 130 such as urethane foam, the foam may be injected under pressure through openings 90, 110, 110. After the polyethylene has cooled, air is injected through the openings in the dies and the dies are uncoupled and the float drum removed.

The preformed core is preferably made of any lightweight, floatable material which can be inserted into the float drum prior to fusing top flange 20 and bottom flange 22 together. Any conventional lightweight, buoyant plastic material including foams can be used and those skilled in the art will readily recognize such plastic and thus various plastic compositions are not set forth herein. Preferably, a plastic composition with good compressive strength is chosen. A material that has been found acceptable is polystyrene. Again, the composition of the polystyrene is chosen such that a core having a good compressive strength is produced. Referring to a twin sheet process, the float drum 10 can be formed by placing the polystyrene core in bottom portion 14 as it is cooling after being formed. The polyethylene material contracts when cooling and the contraction will force the walls of polyethylene float tightly against all the external surface of preformed polystyrene core. This will eliminate any bowing or bulging of any of the wall surfaces and the core will provide a support for all of the wall surface area of float 10 and rigidizes the entire float drum 10. By using a polystyrene core, it is possible, because of the added rigidity of the core, to reduce the wall thicknesses of float 10 further. Those skilled in the art will understand that wall thickness is a function of the size of the float. Smaller floats are constructed with smaller wall thickness than larger floats. Therefore, whatever standard practice calls for wall thickness for float drums made according to the conventional twin sheet process, float drums of the present invention can be constructed of a lesser wall thickness because of the added rigidity of the polystyrene core.

Another method of placing a flotation substance 130 into the interior of float drum 10 is to pour plastic beads or pellets in one or more of openings 90, 100, 110 and subsequently heating the beads or pellets until they expand and cure to form a flotation substance which fills the interior of the float drum. Many types of plastics can be used. One particular plastic is styrene beads. These beads can be rapidly inserted into float drum 10 through large opening 90. As shown in FIG. 1, opening 90 is larger than openings 100 and 110 so that a large volume of beads can be quickly inserted into the interior of float drum 10. Openings 100 and 110 can be used to visually gauge whether enough beads have been placed into float drum 10. After the beads are placed into the float drum, the beads are heated. One method of heating is to place heating rods into one or more of openings 90, 100, 110. Once the plastic beads have been sufficiently heated, the heating rods are removed from the openings.

Referring to FIG. 1, openings 90 and 100 are sealed with covers 92 and 102 respectively. The covers are preferably placed in their respective openings and irremovably secured in the openings. The covers can be glued, fused or the like in the openings.

Figure 2:
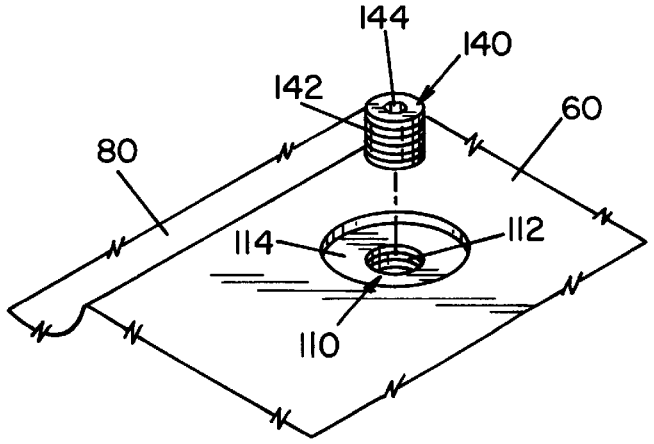
FIG. 2 is an enlarged sectional view of the float drum in FIG. 1 which illustrates the pressure release mechanism.
Figure 3:
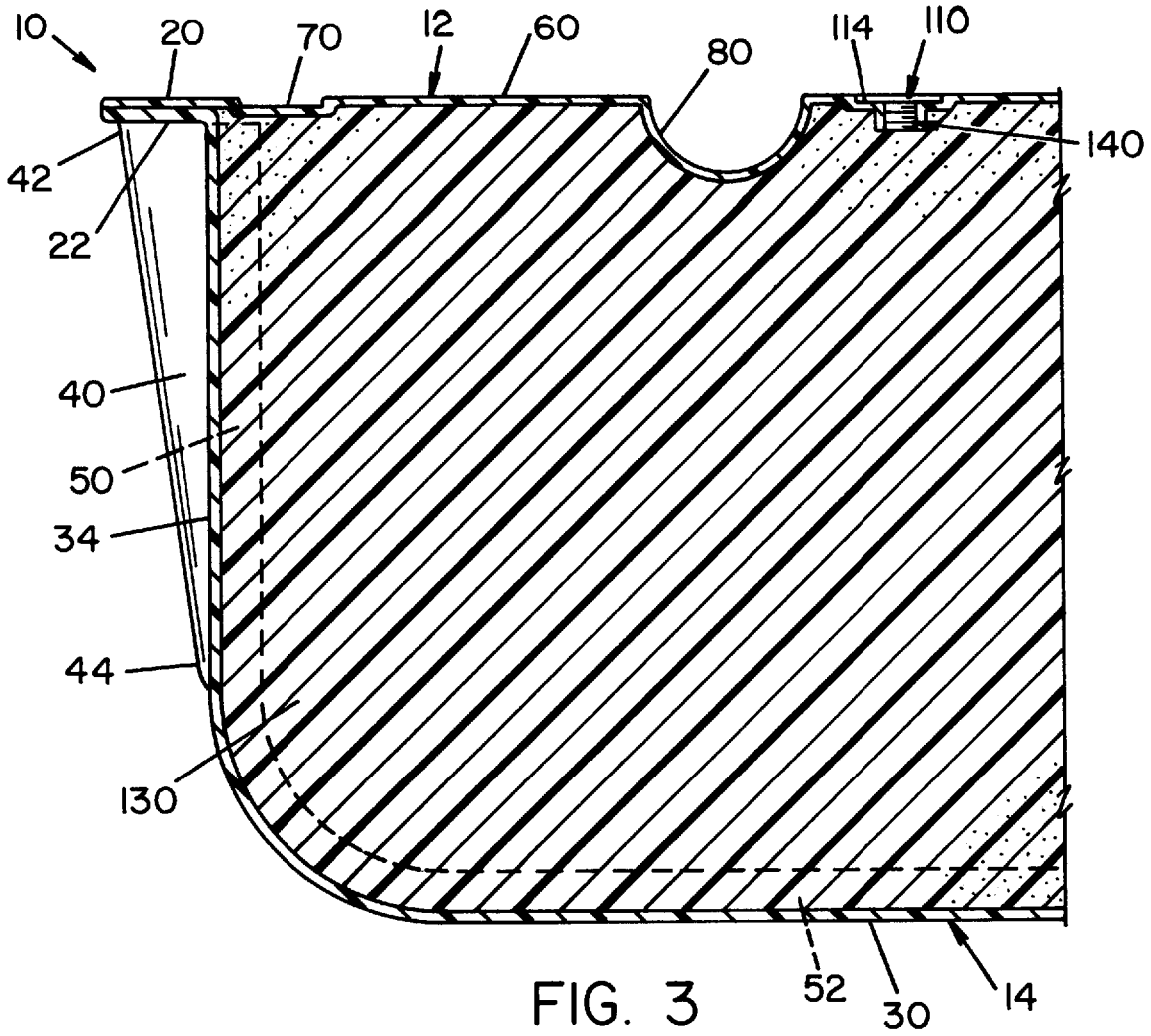
FIG. 3 is a cross-sectional view along line 3—3 of FIG. 1.
Figure 4:
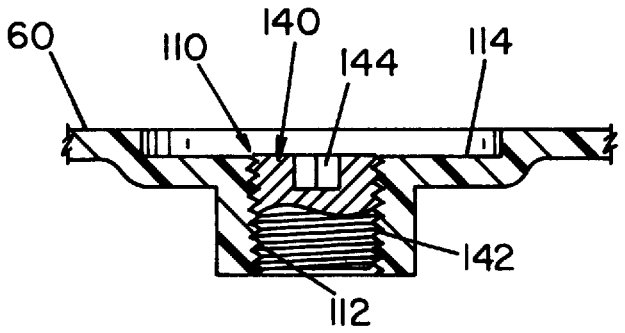
FIG. 4 is an enlarged cross-sectional view of FIG. 3 which illustrates the pressure release mechanism.

Referring now to FIG. 1, 2 and 4, a fluid regulator 140 seals opening 110. Regulator 140 is designed to be removable from opening 110. In one embodiment, regulator 140 is a cylindrical piece which includes grooves 142 and a slot 144. Grooves 142 are designed to be screwed into threads 112 in opening 110 as shown in FIGS. 2–4. As shown in FIGS. 3–4, regulator 140 is designed to be inserted until the top of the regulator is substantially flush with surface 114 of opening 110. In the shown preferred embodiment, surface 114 is slightly recessed from the surface of top wall 60. This recessed surface is designed to protect regulator 140 from being damaged when dock structures are placed on top wall 60.

Slot 144 in regulator 144 is designed to receive a tool for screwing and/or unscrewing regulator 144 from opening 110. In one embodiment, slot 144 is designed to receive an Allen wrench.

Referring specifically to FIG. 4, regulator 140 essentially seals opening 110 when inserted into the opening and substantially prevents fluids from entering or exiting the interior of float drum 10. In practice, regulator 140 is inserted into opening 110 prior to float drum 10 being placed into the water. Regulator 140 thereby prevents water from entering the interior of float drum 10. When the float drum is removed from the water, regulator 140 is removed from opening 110 to allow a build-up of gases and/or formed gases to escape from the interior of float drum 10. The formation of gases in the interior of the float drum is primarily a result of reactions within flotation substance 130. Reactions within the flotation substances are primarily catalyzed by heat. When float drum 10 is out of the water and stored in a warm location and/or exposed to the sun, the interior of the float drum increases in temperatures which can cause reactions in the flotation substance. Typically, the reactions generate gases. These formed gases are allowed to escape by regulator 140. When float drum 10 is in the water, the water constantly cools the float drum thereby naturally regulating the temperature within the float drum and reducing and/or inhibiting reactions in the flotation substances.

Figure 5:
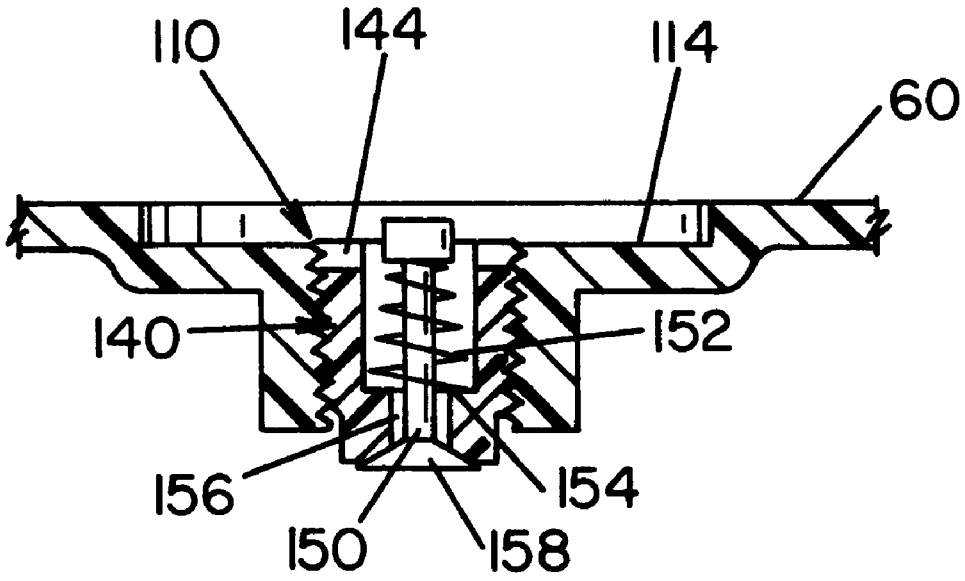
FIG. 5 is an enlarged cross-sectional view of FIG. 3 which illustrates another embodiment of the pressure release mechanism.
Figure 6:
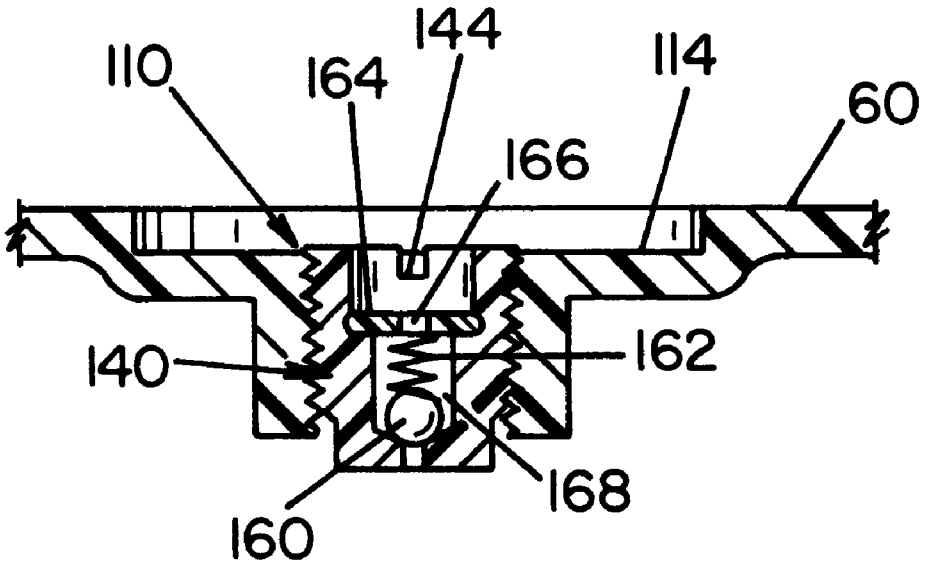
FIG. 6 is an enlarged cross-sectional view of FIG. 3 which illustrates still another embodiment of the pressure release mechanism.

Referring now to FIGS. 5 and 6, alternative embodiments of regulator 140 are shown. In these two embodiments, regulator 140 is designed to be left in opening 110 when float drum 10 is in and out of the water. Referring to FIG. 5, regulator 140 includes a plug 150, a spring 152, a spring landing 154, a gas passageway 156 and a plug seal 158. Plug seal 158 is designed to seal the bottom of passageway 156 to prevent gas from escaping the interior of the float drum 10. Spring 152 biases plug 150 upwardly to effect a positive seal. Spring 152 sits on spring landing 154 and exerts a force upwardly on the top part of plug 150. The bias by the spring on the plug is such that plug seal 158 does not allow water into the interior of the float drum when the float drum is placed in the water. The pressure in the float drum is equalized with ambient pressures by depressing the top of plug 150 to allow fluids in the interior of float drum 10 to pass through gas passageway 156 and out of float drum 10.

Referring now to FIG. 6, regulator 140 includes a plug ball 160, spring 162, gasket 164, gasket hole 166, and a gas passageway 168. Plug ball 160 is designed to seal gas passageway 168 by sitting on a narrow portion of the gas passageway. Spring 162 biases ball 160 downward to effect a positive seal. Spring 162 is positioned between gasket 164 and ball 160. Regulator 140 in FIG. 6 is designed to automatically release fluids in the interior of float drum 10 when a sufficient amount of pressure exists inside of float drum 10. When a predetermined amount of pressure is exceeded in float drum 10, the pressure forces ball 160 upwardly and compresses spring 162. Fluids are allowed to flow through gas passageway 168 and through gasket hole 166 and out of float drum 10. When the pressure falls below predetermined pressure, spring 162 forces ball 160 downwardly to once again seal passageway 168 to prevent gases from exiting float drum 10 and to also prevent water from entering float drum 10.

The invention has been described with reference to a preferred embodiment and alternates thereof. It is believed that many modifications and alterations to the embodiments disclosed will readily suggest itself to the those skilled in the art upon reading and understanding the detailed description of the invention. It is intended to include all such modifications and alterations insofar as they come within the scope of the present invention.

Having thus defined my invention, I claim:

1. A float drum for supporting marine structures comprising a top wall portion terminating in a circumscribing top flange, a bottom wall portion terminating in a circumscribing bottom flange, said top flange and said bottom flange connected together to define an enclosure having a configuration defined by the interior surfaces of said top and bottom portions, and a flotation material substantially filling the entire volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a load bearing rigidizing bottom side flange circumscribing said bottom wall portion and extending away from said bottom wall, at least one of said side walls being relatively flat and having at least one flange supporting rib integrally formed therein and interrupting the flatness of said side wall, said top wall portion having a top wall, at least one longitudinal structural rib and at least one latitudinal structural rib, said top wall terminating in a load bearing, rigidizing top side flange, said top wall of said top portion being generally flat and including a circumscribing drainage indentation and a fluid regulator, said drainage indentation spaced inwardly from the outer edge of said top flange.

2. The float drum of claim 1 wherein said bottom portion has a thickness that is greater than said top portion.

3. The float drum of claim 2 wherein at least one of said flange supporting ribs on said side walls being generally in the shape of a semi-circular truncated cone with its larger diameter portion integral with said flange and its smaller diameter portion somewhat adjacent to said bottom wall.

4. The float drum of claim 3 wherein at least one of said end walls of said bottom portion being relatively flat and having at least one supporting flange integrally formed therein and interrupting the flatness of said end wall, said supporting flange being generally in the shape of a semi-circular truncated cone with its larger diameter portion integral with said flange and its smaller diameter portion somewhat adjacent to said bottom wall.

5. The float drum of claim 4 wherein said float drum being formed by a twin sheet process and said bottom flange and said top flange being sealed together.

6. The float drum of claim 5 wherein said side walls and said bottom wall of said bottom portion including at least one integral structural indentation.

7. The float drum of claim 6 wherein said structural indentation being partially rectangular in cross-sectional shape.

8. The float drum of claim 7 wherein said circumscribing drainage indentation on said top wall being partially rectangular in cross-sectional shape.

9. The float drum of claim 8 wherein said longitudinal structural rib extending substantially the complete length of said top portion, said longitudinal structural rib extending generally down the middle of said top portion.

10. The float drum of claim 9 wherein said latitudinal structural rib extending substantially the complete lateral length of said top portion, said latitudinal structural rib spaced from the middle of said top portion.

11. The float drum of claim 10 wherein said top wall includes at least one opening adapted to provide a passageway for inserting said floatation material in said enclosure, said opening being substantially sealed by a cover.

12. The float drum of claim 11 wherein said top portion includes a plurality of attachment indicators positioned on said top flange.

13. The float drum of claim 12 wherein said regulator including a fluid opening and a removable plug, said plug substantially sealing said enclosure when said plug positioned in said fluid opening.

14. The float drum of claim 1 wherein at least one of said flange supporting ribs on said side walls being generally in the shape of a semi-circular truncated cone with its larger diameter portion integral with said flange and its smaller diameter portion somewhat adjacent to said bottom wall.

15. The float drum of claim 1 wherein at least one of said end walls of said bottom portion being relatively flat and having at least one supporting flange integrally formed therein and interrupting the flatness of said end wall, said supporting flange being generally in the shape of a semi-circular truncated cone with its larger diameter portion integral with said flange and its smaller diameter portion somewhat adjacent to said bottom wall.

16. The float drum of claim 1 wherein said float drum being formed by a twin sheet process and said bottom flange and said top flange being sealed together.

17. The float drum of claim 1 wherein said side walls and said bottom wall of said bottom portion including at least one integral structural indentation.

18. The float drum of claim 17 wherein said structural indentation being partially rectangular in cross-sectional shape.

19. The float drum of claim 1 wherein said circumscribing drainage indentation on said top wall being partially rectangular in cross-sectional shape.

20. The float drum of claim 1 wherein said longitudinal structural rib extending substantially the complete length of said top portion, said longitudinal structural rib extending generally down the middle of said top portion.

21. The float drum of claim 1 wherein said latitudinal structural rib extending substantially the complete lateral length of said top portion, said latitudinal structural rib spaced from the middle of said top portion.

22. The float drum of claim 1 wherein said top wall includes at least one opening adapted to provide a passageway for inserting said floatation material in said enclosure, said opening being substantially sealed by a cover.

23. The float drum of claim 1 wherein said top portion includes a plurality of attachment indicators positioned on said top flange.

24. The float drum of claim 1 wherein said regulator including a fluid opening and a removable plug, said plug substantially sealing said enclosure when said plug positioned in said fluid opening.

25. A float drum for supporting marine structures comprising a top wall portion terminating in a circumscribing top flange, a bottom wall portion terminating in a circumscribing bottom flange, said top flange and said bottom flange connected together to define an enclosure having a configuration defined by the interior surfaces of said top and bottom portions, and a flotation material substantially filling the entire volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a load bearing rigidizing bottom side flange circumscribing said bottom wall portion and extending away from said bottom wall, at least one of said side walls being relatively flat and having at least one flange supporting rib integrally formed therein and interrupting the flatness of said side wall, said top wall portion having a top wall, at least one longitudinal structural rib and at least one latitudinal structural rib, said top wall terminating in a load bearing, rigidizing top side flange, said top wall of said top portion being generally flat and including a circumscribing indentation and a fluid regulator said regulator including a fluid passageway and a valve, said valve allowing fluids in said enclosure, to flow through said fluid passageway when said valve is depressed.

26. A float drum for supporting marine structures being formed by a twin sheet process and comprising a top wall portion terminating in a circumscribing top flange, a bottom wall portion terminating in a circumscribing bottom flange, said top flange and said bottom flange connected together to define an enclosure having a configuration defined by the interior surfaces of said top and bottom portions, and a flotation material substantially filling the entire volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a load bearing rigidizing bottom side flange circumscribing said bottom wall portion and extending away from said bottom wall, at least one of said side walls being relatively flat and having at least one flange supporting rib integrally formed therein and interrupting the flatness of said side wall, said top wall portion having a top wall, at least one longitudinal structural rib and at least one latitudinal structural rib, said top wall terminating in a load bearing, rigidizing top side flange, said top wall of said top portion being generally flat and including a circumscribing indentation and a fluid regulator, said top portion including a plurality of attachment indicators positioned on said top flange, said top wall including at least one opening adapted to provide a passageway for inserting said floatation material in said enclosure, said opening being substantially sealed by a cover, said latitudinal structural rib extending between said top side flange of said top portion, said latitudinal structural rib spaced from the middle of said top portion, said longitudinal structural rib extending substantially the complete length of said top portion, said longitudinal structural rib extending generally down the middle of said top portion, said circumscribing indentation on said top wall being partially rectangular in cross-sectional shape, said side walls and said bottom wall of said bottom portion including at least one integral structural indentation being partially rectangular in cross-sectional shape, said bottom flange and said top flange being sealed together, at least one of said end walls of said bottom portion being relatively flat and having at least one supporting flange integrally formed therein and interrupting the flatness of said end wall, said supporting flange being generally in the shape of a semi-circular truncated cone with its larger diameter portion integral with said flange and its smaller diameter portion somewhat adjacent to said bottom wall, at least one of said flange supporting ribs on said side walls being generally in the shape of a semi-circular truncated cone with its larger diameter portion integral with said flange and its smaller diameter portion somewhat adjacent to said bottom wall, said bottom portion has a thickness that is greater than said top portion, said regulator including a fluid passageway and a valve, said valve allowing fluids in said enclosure to flow through said fluid passageway when said valve is depressed.

27. A float drum for supporting marine structures comprising a top wall portion terminating in a circumscribing top flange, a bottom wall portion terminating in a circumscribing bottom flange, said top flange and said bottom flange connected together to define an enclosure having a configuration defined by the interior surfaces of said top and bottom portions, and a flotation material substantially filling the entire volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a load bearing rigidizing bottom side flange circumscribing said bottom wall portion and extending away from said bottom wall, at least one of said side walls being relatively flat and having at least one flange supporting rib integrally formed therein and interrupting the flatness of said side wall, said top wall portion having a top wall, at least one longitudinal structural rib and at least one latitudinal structural rib, said top wall terminating in a load bearing, rigidizing top side flange, said top wall of said top portion being generally flat and including a circumscribing indentation and a fluid regulator, said regulator including a fluid passageway and a valve, said valve allowing fluids in said enclosure to flow through said fluid passageway when a pressure inside said enclosure exceeds a predefined pressure.

28. A float drum for supporting marine structures being formed by a twin sheet process and comprising a top wall portion terminating in a circumscribing top flange, a bottom wall portion terminating in a circumscribing bottom flange, said top flange and said bottom flange connected together to define an enclosure having a configuration defined by the interior surfaces of said top and bottom portions, and a flotation material substantially filling the entire volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a load bearing rigidizing bottom side flange circumscribing said bottom wall portion and extending away from said bottom wall, at least one of said side walls being relatively flat and having at least one flange supporting rib integrally formed therein and interrupting the flatness of said side wall, said top wall portion having a top wall, at least one longitudinal structural rib and at least one latitudinal structural rib, said top wall terminating in a load bearing, rigidizing top side flange, said top wall of said top portion being generally flat and including a circumscribing indentation and a fluid regulator, said top portion including a plurality of attachment indicators positioned on said top flange, said top wall including at least one opening adapted to provide a passageway for inserting said floatation material in said enclosure, said opening being substantially sealed by a cover, said latitudinal structural rib extending between said top side flange of said top portion, said latitudinal structural rib spaced from the middle of said top portion, said longitudinal structural rib extending between said top side flange of said top portion, said longitudinal structural rib extending generally down the middle of said top portion, said circumscribing indentation on said top wall being partially rectangular in cross-sectional shape, said side walls and said bottom wall of said bottom portion including at least one integral structural indentation being partially rectangular in cross-sectional shape, said bottom flange and said top flange being sealed together, at least one of said end walls of said bottom portion being relatively flat and having at least one supporting flange integrally formed therein and interrupting the flatness of said end wall, said supporting flange being generally in the shape of a semi-circular truncated cone with its larger diameter portion integral with said flange and its smaller diameter portion somewhat adjacent to said bottom wall, at least one of said flange supporting ribs on said side walls being generally in the shape of a semi-circular truncated cone with its larger diameter portion integral with said flange and its smaller diameter portion somewhat adjacent to said bottom wall, said bottom portion has a thickness that is greater than said top portion, said regulator including a fluid passageway and a valve, said valve allowing fluids in said enclosure to flow through said fluid passageway when a pressure inside said enclosure exceeds a predefined pressure.

29. The float drum of claim 27 wherein said valve being spring biased in a closed position.

30. A float drum for supporting marine structures comprising a top wall portion terminating in a circumscribing top flange, a bottom wall portion terminating in a circumscribing bottom flange, said top flange and said bottom flange connected together to define an enclosure having a configuration defined by the interior surfaces of said top and bottom portions, and a flotation material substantially filling the entire volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a load bearing rigidizing bottom side flange circumscribing said bottom wall portion and extending away from said bottom wall, at least one of said side walls being relatively flat and having at least one flange supporting rib integrally formed therein and interrupting the flatness of said side wall, at least one of said flange supporting ribs being generally in the shape of a semi-circular truncated cone with its larger diameter portion integral with said flange and its smaller diameter portion somewhat adjacent to said bottom wall, at least one of said end walls being relatively flat and having at least one supporting flange integrally formed therein and interrupting the flatness of said end wall, said supporting flange being generally in the shape of a semi-circular truncated cone with its larger diameter portion integral with said flange and its smaller diameter portion somewhat adjacent to said bottom wall, said side walls and said bottom wall of said bottom portion including at least one integral structural indentation, said top wall portion having a top wall, at least one longitudinal structural rib and at least one latitudinal structural rib, said longitudinal structural rib extending substantially the complete length of said top portion, said longitudinal structural rib extending generally down the middle of said top portion, said latitudinal structural rib extending substantially the complete lateral length of said top portion, said top wall terminating in a load bearing, rigidizing top side flange, said top wall of said top portion being generally flat and including a circumscribing drainage indentation, a fluid regulator and at least one opening adapted to provide a passageway for inserting said floatation material in said enclosure, said opening being substantially sealed by a cover, said top flange including a plurality of attachment indicators.

31. The float drum of claim 30 wherein said structural indentation being partially rectangular in cross-sectional shape.

32. The float drum of claim 31 wherein said circumscribing drainage indentation on said top wall being partially rectangular in cross-sectional shape.

33. The float drum of claim 32 wherein said longitudinal structural rib having a generally semi-circular cross-sectional shape.

34. The float drum of claim 33 wherein said latitudinal structural rib having a generally semi-circular cross-sectional shape and spaced from the middle of said top portion.

35. The float drum of claim 34 wherein said regulator including a fluid opening and a removable plug, said plug substantially sealing said enclosure when said plug positioned in said fluid opening.

36. The float drum of claim 30 wherein said circumscribing drainage indentation on said top wall being partially rectangular in cross-sectional shape.

37. The float drum of claim 30 wherein said longitudinal structural rib having a generally semi-circular cross-sectional shape.

38. The float drum of claim 30 wherein said latitudinal structural rib having a generally semi-circular cross-sectional shape and spaced from the middle of said top portion.

39. The float drum of claim 30 wherein said regulator including a fluid opening and a removable plug, said plug substantially sealing said enclosure when said plug positioned in said fluid opening.

40. The float drum of claim 30 wherein said regulator including a fluid passageway and a valve, said valve allowing fluids in said enclosure to flow through said fluid passageway when said valve is depressed.

41. A float drum for supporting marine structures comprising a top wall portion terminating in a circumscribing top flange, a bottom wall portion terminating in a circumscribing bottom flange, said top flange and said bottom flange connected together to define an enclosure having a configuration defined by the interior surfaces of said top and bottom portions, and a flotation material substantially filling the entire volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a load bearing rigidizing bottom side flange circumscribing said bottom wall portion and extending away from said bottom wall, at least one of said side walls being relatively flat and having at least one flange supporting rib integrally formed therein and interrupting the flatness of said side wall, at least one of said flange supporting ribs being generally in the shape of a semi-circular truncated cone with its larger diameter portion integral with said flange and its smaller diameter portion somewhat adjacent to said bottom wall, at least one of said end walls being relatively flat and having at least one supporting flange integrally formed therein and interrupting the flatness of said end wall, said supporting flange being generally in the shape of a semi-circular truncated cone with its larger diameter portion integral with said flange and its smaller diameter portion somewhat adjacent to said bottom wall, said side walls and said bottom wall of said bottom portion including at least one integral structural indentation, said top wall portion having a top wall, at least one longitudinal structural rib and at least one latitudinal structural rib, said longitudinal structural rib extending between said top flange of said top portion, said longitudinal structural rib extending generally down the middle of said top portion, said latitudinal structural rib extending between said top flange of said top portion, said top wall terminating in a load bearing, rigidizing top side flange, said top wall of said top portion being generally flat and including a circumscribing indentation, a fluid regulator and at least one opening adapted to provide a passageway for inserting said floatation material in said enclosure, said opening being substantially sealed by a cover, said top flange including a plurality of attachment indicators, said structural indentation being partially rectangular in cross-sectional shape, said circumscribing indentation on said top wall being partially rectangular in cross-sectional shape, said longitudinal structural rib having a generally semi-circular cross-sectional shape, said latitudinal structural rib having a generally semi-circular cross-sectional shape and spaced from the middle of said top portion, said regulator including a fluid passageway and a valve, said valve allowing fluids in said enclosure to flow through said fluid passageway when said valve is depressed.

42. A float drum for supporting marine structures comprising a top wall portion terminating in a circumscribing top flange, a bottom wall portion terminating in a circumscribing bottom flange, said top flange and said bottom flange connected together to define an enclosure having a configuration defined by the interior surfaces of said top and bottom portions, and a flotation material substantially filling the entire volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a load bearing rigidizing bottom side flange circumscribing said bottom wall portion and extending away from said bottom wall, at least one of said side walls being relatively flat and having at least one flange supporting rib integrally formed therein and interrupting the flatness of said side wall, at least one of said flange supporting ribs being generally in the shape of a semi-circular truncated cone with its larger diameter portion integral with said flange and its smaller diameter portion somewhat adjacent to said bottom wall, at least one of said end walls being relatively flat and having at least one supporting flange integrally formed therein and interrupting the flatness of said end wall, said supporting flange being generally in the shape of a semi-circular truncated cone with its larger diameter portion integral with said flange and its smaller diameter portion somewhat adjacent to said bottom wall, said side walls and said bottom wall of said bottom portion including at least one integral structural indentation, said top wall portion having a top wall, at least one longitudinal structural rib and at least one latitudinal structural rib, said longitudinal structural rib extending substantially the complete length of said top portion said longitudinal structural rib extending generally down the middle of said top portion, said latitudinal structural rib extending substantially the complete lateral length of said top portion, said top wall terminating in a load bearing, rigidizing top side flange, said top wall of said top portion being generally flat and including a circumscribing drainage indentation, a fluid regulator and at least one opening adapted to provide a passageway for inserting said floatation material, in said enclosure, said opening being substantially sealed by a cover, said top flange including a plurality of attachment indicators, said regulator including a fluid passageway and a valve, said valve allowing fluids in said enclosure to flow through said fluid passageway when a pressure inside said enclosure exceeds a predefined pressure.

43. A float drum for supporting marine structures comprising a top wall portion terminating in a circumscribing top flange, a bottom wall portion terminating in a circumscribing bottom flange, said top flange and said bottom flange connected together to define an enclosure having a configuration defined by the interior surfaces of said top and bottom portions, and a flotation material substantially filling the entire volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in a load bearing rigidizing bottom side flange circumscribing said bottom wall portion and extending away from said bottom wall, at least one of said side walls being relatively flat and having at least one flange supporting rib integrally formed therein and interrupting the flatness of said side wall, at least one of said flange supporting ribs being generally in the shape of a semi-circular truncated cone with its larger diameter portion integral with said flange and its smaller diameter portion somewhat adjacent to said bottom wall, at least one of said end walls being relatively flat and having at least one supporting flange integrally formed therein and interrupting the flatness of said end wall, said supporting flange being generally in the shape of a semi-circular truncated cone with nits larger diameter portion integral with said flange and its smaller diameter portion somewhat adjacent to said bottom wall, said side walls and said bottom wall of said bottom portion including at least one integral structural indentation, said top wall portion having a top wall, at least one longitudinal structural rib and at least one latitudinal structural rib, said longitudinal structural rib extending between said top flange of said top portion, said longitudinal structural rib extending generally down the middle of said top portion, said latitudinal structural rib extending between said top flange of said top portion, said top wall terminating in a load bearing, rigidizing top side flange, said top wall of said top portion being generally flat and including a circumscribing indentation, a fluid regulator and at least one opening adapted to provide a passageway for inserting said floatation material in said enclosure, said opening being substantially sealed by a cover, said top flange including a plurality of attachment indicators, said structural indentation being partially rectangular in cross-sectional shape, said circumscribing indentation on said top wall being partially rectangular in cross-sectional shape, said longitudinal structural rib having a generally semi-circular cross-sectional shape, said latitudinal structural rib having a generally semi-circular cross-sectional shape and spaced from the middle of said top portion, said regulator including a fluid passageway and a valve, said valve allowing fluids in said enclosure to flow through said fluid passageway when a pressure inside said enclosure exceeds a predefined pressure.

44. A float drum for supporting structures comprising a top wall portion terminating in a circumscribing top wall end, a bottom wall portion terminating in a circumscribing bottom wall end, said top wall end and said bottom wall end connected together to define an enclosure having a configuration defined by the interior surfaces of said top and bottom portions, and a flotation material at least partially filling the volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in said bottom wall, said top wall portion having a top wall and at least one structural rib, said top wall terminating in said top wall end; said top wall of said top portion being generally flat and including a fluid regulator, said fluid regulator including a passageway to entrap fluids within and to controllably remove fluids from said enclosure.

45. The float drum as defined in claim 44, wherein said flotation material substantially filling the volume of said enclosure.

46. The float drum as defined in claim 44, wherein said top wall and said bottom wall having a flange, said bottom wall flange extending away from said side and end walls.

47. A float drum for supporting structures comprising a top wall portion terminating in a circumscribing top wall end, a bottom wall portion terminating in a circumscribing bottom wall end, said top wall end and said bottom wall end connected together to define an enclosure having a configuration defined by the interior surfaces of said top and bottom portions, and a flotation material at least partially filling the volume of said enclosure, said bottom wall portion having a bottom wall, a pair of contiguous side walls extending from the sides of said bottom wall, a pair of contiguous end walls extending from the ends of said bottom wall each end wall contiguous with a side wall, each side and end wall terminating in said bottom wall, said top wall portion having a top wall and at least one structural rib, said top wall terminating in said top wall end, said top wall of said top portion being generally flat and including a fluid regulator, said fluid regulator including a passageway to entrap fluids within and to controllably remove fluids from said enclosure, said top wall including a circumscribing drainage indentation to remove fluids from said top surface.

48. The float drum as defined in claim 44, wherein said float drum being formed by a twin sheet process and said bottom wall and said top wall being sealed together.

49. The float drum as defined in claim 47, wherein said circumscribing indentation on said top wall being partially rectangular in cross-sectional shape.

50. The float drum as defined in claim 44, wherein said top portion includes at least one longitudinal structural rib extending substantially the complete length of said top portion.

51. The float drum as defined in claim 50, wherein said top portion includes at least one lateral structural rib extending between said top wall end of said top portion.

52. The float drum as defined in claim 44, wherein said top portion includes a plurality of attachment indicators positioned on said top wall.

53. A float drum for supporting structures comprising a top wall portion terminating in a circumscribing top wall end, a bottom wall portion terminating in a circumscribing bottom wall end, said top wall end and said bottom wall end connected together to define an enclosure having a configuration defined by the interior surfaces of said top and bottom portions, and a flotation material at least partially filling the volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in said bottom wall said top wall portion having a top wall and at least one structural rib, said top wall terminating in said top wall end, said top wall of said top portion being generally flat and including a fluid regulator, said fluid regulator including a passageway to entrap fluids within and to controllably remove fluids from said enclosure, said regulator including a fluid passageway and a valve, said valve allowing fluids in said enclosure to flow through said fluid passageway when said valve is depressed.

54. A float drum for supporting structures comprising a top wall portion terminating in a circumscribing top wall end, a bottom wall portion terminating in a circumscribing bottom wall end, said top wall end and said bottom wall end connected together to define an enclosure having a configuration defined by the interior surfaces of said top and bottom portions, and a flotation material at least partially filling the volume of said enclosure, said bottom wall portion having a bottom wall, a pair of contiguous side walls extending from the sides of said bottom wall, a pair of contiguous end walls extending from the ends of said bottom wall, each end wall continuous with a side wall, each side and end wall terminating in said bottom wall, said top wall portion having a top wall and at least one structural rib, said top wall terminating in said top wall and, said top wall of said top portion being generally flat and including a fluid regulator, said fluid regulator including a passageway to entrap fluids within and to controllably remove fluids from said enclosure, said regulator including a fluid passageway and a valve, said valve allowing fluids in said enclosure to flow through said fluid passageway when a pressure inside said enclosure exceeds a predefined pressure.

55. The float drum as defined in claim 54, wherein said valve being spring biased in a closed position.

56. A float drum for supporting structures comprising a top wall portion terminating in a circumscribing top flange, a bottom wall portion terminating in a circumscribing bottom flange, said top flange and said bottom flange connected together to define an enclosure having a configuration defined by the interior surfaces of said top and bottom portions, and a flotation material at least partially filling the volume of said enclosure, said bottom wall portion having a bottom wall, a pair of contiguous side walls extending from the sides of said bottom wall, a pair of contiguous end walls extending from the ends of said bottom wall, each end wall contiguous with a side wall, each side and end wall terminating in said bottom flange, said top wall portion having a top wall and at least one structural rib, said top wall terminating in said top flange, said top wall of said top portion being generally flat and including a circumscribing drainage indentation to remove fluids from said top surface, said drainage indentation spaced inwardly from the outer edge of said top flange.

57. The float drum as defined in claim 56, wherein said circumscribing indentation on said top wall being partially rectangular in cross-sectional shape.

58. The float drum as defined in claim 56, including a fluid regulator, said fluid regulator including a passageway to entrap fluids within and to controllably remove fluids from said enclosure.

59. The float drum as defined in claim 58, wherein said regulator including a fluid passageway and a valve, said valve allowing fluids in said enclosure to flow through said fluid passageway when said valve is depressed.

60. The float drum as defined in claim 58, wherein said regulator including a fluid passageway and a valve, said valve allowing fluids in said enclosure to flow through said fluid passageway when a pressure inside said enclosure exceeds a predefined pressure.

61. The float drum as defined in claim 60, wherein said valve being spring biased in a closed position.

62. The float drum as defined in claim 56, wherein said flotation material substantially filling the volume of said enclosure.

63. The float drum as defined in claim 56, wherein said float drum being formed by a twin sheet process and said bottom flange and said top flange being sealed together.

64. The float drum as defined in claim 56, wherein said top portion includes at least one longitudinal structural rib extending substantially the complete length of said top portion.

65. The float drum as defined in claim 64, wherein said top portion includes at least one lateral structural rib extending between said top wall end of said top portion.

66. The float drum as defined in claim 56, wherein said top portion includes a plurality of attachment indicators positioned on said top flange.

* * * * *